United States Patent [19]

Sopory

[11] Patent Number: 4,591,700

[45] Date of Patent: May 27, 1986

[54] PTC COMPOSITIONS

[75] Inventor: Umesh K. Sopory, San Jose, Calif.

[73] Assignee: Raychem Corporation, Menlo Park, Calif.

[21] Appl. No.: 589,032

[22] Filed: Mar. 12, 1984

Related U.S. Application Data

[63] Continuation of Ser. No. 150,909, May 19, 1980, abandoned.

[51] Int. Cl.[4] ..... H05B 1/02

[52] U.S. Cl. ..... 219/505; 219/552; 219/553; 252/511; 524/495; 524/496

[58] Field of Search ..... 252/511, 512, 518, 503, 252/506; 524/495, 496, 500, 544–546; 219/505, 541, 542, 543, 548, 552, 553

[56] References Cited

U.S. PATENT DOCUMENTS

| | | | |
|---|---|---|---|
| 3,793,716 | 2/1974 | Smith-Johannsen | 29/611 |
| 3,823,217 | 7/1974 | Kampe | 264/105 |
| 3,861,029 | 1/1975 | Smith-Johannsen et al. | 29/611 |
| 3,914,363 | 10/1975 | Bedard et al. | 264/105 |
| 3,951,871 | 4/1976 | Lloyd et al. | 252/511 |
| 4,188,276 | 2/1980 | Lyons et al. | 204/159 |
| 4,237,441 | 12/1980 | Van Konynenburg et al. | 252/511 |
| 4,242,573 | 12/1980 | Batliwalla | 219/528 |

FOREIGN PATENT DOCUMENTS

| | | |
|---|---|---|
| 0008235 | 2/1980 | European Pat. Off. . |
| 2755076 | 12/1977 | Fed. Rep. of Germany . |
| 2755077 | 12/1977 | Fed. Rep. of Germany . |
| 2821799 | 5/1978 | Fed. Rep. of Germany . |
| 2937708 | 9/1979 | Fed. Rep. of Germany . |
| 2321751 | 3/1977 | France . |
| 1195076 | 6/1970 | United Kingdom . |
| 1338953 | 11/1973 | United Kingdom . |
| 1373711 | 11/1974 | United Kingdom . |
| 1384016 | 2/1975 | United Kingdom . |
| 1457157 | 12/1976 | United Kingdom . |
| 1478927 | 7/1977 | United Kingdom . |
| 2047957 | 12/1980 | United Kingdom . |

*Primary Examiner*—Josephine L. Barr

*Attorney, Agent, or Firm*—Timothy H. P. Richardson; Herbert G. Burkard

[57] ABSTRACT

Novel PTC conductive polymer compositions contain a mixture of two crystalline polymers of different melting points, the higher melting of the polymers having a melting point which is at least 160° C. and at least 25° C. higher than the melting point of the other polymer. The compositions do not increase in resistivity by a factor more than 2 when maintained at 150° C. for 1000 hours, and are therefore particularly suitable for self-limiting heaters which can be used on apparatus which is periodically subjected to high temperatures, e.g. during steam-cleaning thereof.

17 Claims, 1 Drawing Figure

PTC COMPOSITIONS

This application is a continuation of application Ser. No. 150,909, filed May 19, 1980, now abandoned.

BACKGROUND OF THE INVENTION

1. Field of the Invention

This invention relates to the PTC conductive polymer compositions and electrical devices containing them, especially self-limiting strip heaters.

2. Summary of the Prior Art

PTC conductive polymer compositions are known for use in self-limiting strip heaters and in other electrical devices; such compositions can contain two crystalline polymers having substantially different melting points. It is also known to anneal PTC compositions, after they have been shaped, in order to reduce their resistivity, by heating them for extended period, e.g. of several hours, at a temperature above the melting point of the composition. Reference may be made for example to U.S. Pat. Nos. 3,793,716, 3,823,217, (Kampe), 3,861,029 (Smith-Johannsen et al), U.S. Pat. No. 3,914,363 (Bedard et al), U.S. Pat. No. 4,177,376 (Horsma et al) and to U.S. patent application Ser. Nos. 84,352 filed 10-12-79 (Horsma et al), 732,792 filed 10-15-76 (Van Konynenburg et al) now abandoned, 751,095 filed 7-2-85 (Toy et al), 798,154 filed 5-18-77 (Horsma), now abandoned, 965,343 filed 12-1-78 (Van Konynenburg et al) now U.S. Pat. No. 4,237,441, 965,344 filed 12-1-78 (Middleman et al) now U.S. Pat. No. 4,238,812, 965,345 filed 12-1-78 (Middleman et al), now U.S. Pat. No. 4,242,573, and 75,413 filed 9-14-79 (Van Konynenburg), now U.S. Pat. No. 4,304,987, and the eight applications filed Apr. 21, 1980 by Gotcher et al Ser. No. 141,984, now abandoned (MP0712, 157/111), Middleman et al, Ser. No. 141,987, now U.S. Pat. No. 4,413,301, (MP0713, 157/112), Fouts et al, Ser. No. 141,988, now abandoned (MP0714, 157/113), Evans, Ser. No. 141,989 (MP0715, 157/114), Walty, Ser. No. 141,990, now U.S. Pat. No. 4,314,231, (MP0719, 157/161), Fouts et al, Ser. No. 141,991, now U.S. Pat. No. 4,545,926, (MP0720, 157/162), Middleman et al, Ser. No. 142,053, now U.S. Pat. No. 4,352,083, (MP0724, 157/167) and Middleman et al, Ser. No. 142,054, now U.S. Pat. No. 4,317,027, (MP0725, 157/168). The disclosure of each of these patents and applications is incorporated herein by reference.

The known self-limiting strip heaters are not satisfactory for use in situations in which they may be externally heated to temperatures substantially higher than the temperatures which they reach during their normal use as heaters, as for example during intermittent steam-cleaning of pipes which are heated by the heater during normal operation. When exposed to such temperatures, known heaters, whether powered or not during the exposure, increase in resistivity at a rate which rapidly renders them ineffective.

SUMMARY OF THE INVENTION

It has now been discovered that self-limiting strip heaters which have an extended service life, even when subjected intermittently to high temperatures such as those which arise during steam-cleaning of pipes or other apparatus which are heated by the heater during normal operation, can be made from a conductive polymer composition which exhibits PTC behavior, which comprises (a) a polymer component which comprises a mixture of a first crystalline polymer having a first melting point, $T_1$, and a second crystalline polymer having a second melting point, $T_2$, which is at least 160° C. and at least $(T_1+25)$°C., and (b) a particulate filler component which has been dispersed in said polymer component and which comprises a conductive filler, which has a resistivity at 25° C. of $\rho_o$ ohm.cm and which has a resistivity at 25° C. after being maintained at a temperature of 150° C. for 1000 hours, $\rho_{1000}$, which is less than $2\times\rho_o$.

BRIEF DESCRIPTION OF THE DRAWING

The invention is illustrated in the accompanying drawing in which the FIGURE is a cross-section through a preferred self-limiting strip heater of the invention.

DETAILED DESCRIPTION OF THE INVENTION

Figure 1:
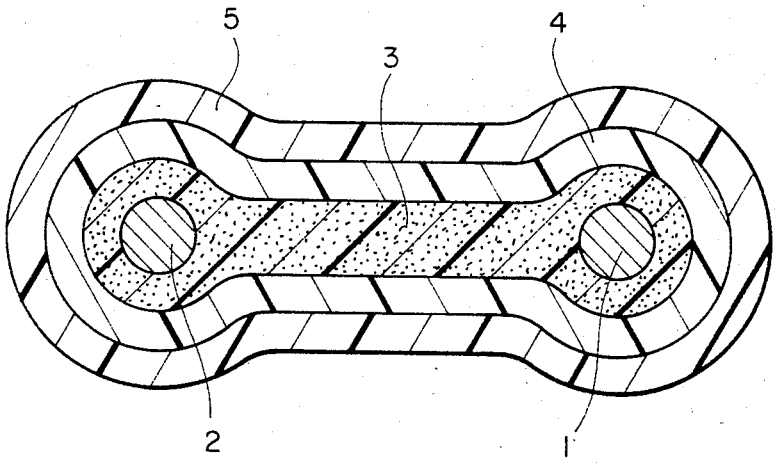

In the compositions of the invention, the melting point of the second polymer $T_2$, is preferably at least $(T_1+50)$°C., particularly at least $(T_1+70)$°C., especially at least $(T_1+90)$°C. $T_2$ is preferably at least 200° C., especially at least 230° C. The mixture of crystalline polymers is generally a physical mixture of two distinct polymers but may be a single polymer, e.g. a block copolymer, having distinct segments such that the polymer has two distinct melting points. The melting points referred to are the peak values of the peaks of a DSC (differential scanning calorimeter) curve. $T_1$ is selected for the desired switching temperature ($T_s$) of the composition, and may be for example 100° C. to 175° C. One or both of the polymers may be a fluorinated polymer, for example the lower melting polymer may be polyvinylidene fluoride and the higher melting polymer an ethylene/tetrafluoroethylene polymer. Each of the polymers is crystalline, and this term is used herein to mean that that the polymer has a crystallinity of at least 1% preferably at least 5%, particularly at least 10%, especially at least 20%, as measured by X-ray diffraction. The polymer component can also contain other polymers, e.g. elastomers, preferably in amounts which do not substantially affect the electrical characteristics of the composition, usually less than 25%, preferably less than 15%, especially less than 10%, by weight.

The ratio by weight of the first polymer to the second polymer is preferably from 1:3 to 3:1, particularly from 1:2 to 2:1, especially from 0.5 to 1, more especially from 0.6 to 0.8. The first and second polymers are preferably incompatible with each other.

The conductive filler in the compositions of the invention will often consist of or contain one or more carbon blacks, though other conductive fillers can be used. The amount of conductive filler will be selected with a view to the required resistivity, which at 25° C., after the annealing of the composition which is normally carried out in making a heater or other device therefrom, is preferably $10^2$ to $10^5$ ohm.cm. When using a carbon black as the conductive filler, the amount thereof may be for example 8 to 40% by weight of the composition, e.g. 10 to 15%.

The particulate filler component may in addition contain a non-conductive filler, e.g. in amount 10 to 25% by weight of the composition.

The compositions can be processed into strip heaters and other devices suitable for use at line voltages of 120 volts or more by methods known in the art, and for this purpose are preferably melt-shapeable. Especially since the second polymer has a melting point greater than 160° C., it may be desirable to include in the composition a suitable processing aid, e.g. one of the titanates known for this purpose. After shaping, the composition can if desired be cross-linked, e.g. by irradiation, but when either or both of the crystalline polymers is a fluorinated polymer, cross-linking is preferably avoided.

It is often desirable to anneal the compositions, after they have been shaped, in order to reduce their resistivity. Such annealing is preferably carried out at $(T_1+5)$°C. to $(T_2-10)$°C. for a time sufficient to reduce the resistivity at 25° C. of the PTC composition from a first value, $\rho_o$, prior to said annealing, to a second value, $\rho_A$, which is less than $0.8\times\rho_o$, preferably less than $0.6\times\rho_o$, with $\rho_A$ preferably being from $10^2$ to $10^5$ ohm.cm. Annealing in this way is described and claimed in my copending commonly assigned application entitled "Improved method for annealing PTC compositions" filed contemporaneously herewith, Ser. No. 150,911, filed May 19, 1980 now U.S. Pat. No. 4,318,881, the disclosure of which is incorporated herein by reference.

The temperature at which the PTC element is annealed, $T_A$, is preferably above $(T_1+10)$°C., and below $(T_2-10)$°C., particularly below $(T_2-40)$°C., especially below $(T_2-75)$°C. $T_A$ will often be closer to $T_1$ than to $T_2$. The composition is preferably annealed for a time such that $\rho_A$ is less than $0.8\times\rho_o$, particularly less than $0.6\times\rho_o$, e.g. 0.1 to $0.8\times\rho_o$, and in some cases to much lower levels, e.g. less than $0.1\times\rho_o$; the annealing time will typically be at least 2 hours, e.g. 4 to 10 hours.

If desired, the heat-treatment of the device in order to anneal the composition can also effect melt fusion between the PTC element and a layer of a second polymeric composition placed around the PTC element, as described and claimed in my copending, commonly assigned application entitled "Novel PTC devices and their preparation" filed contemporaneously herewith, Ser. No. 150,910, filed May 19, 1980 now U.S. Pat. No. 4,334,351, the disclosure of which is incorporated herein by reference.

Referring now to the drawing, wire electrodes 1 and 2 are embedded in PTC element 3, which is surrounded by, and melt-fused at the interface to, a layer of an insulating polymeric composition 3, which is itself surrounded by a further layer of another insulating composition 5.

The invention is illustrated by the following Example.

EXAMPLE

The ingredients used in this Example are given in the Table below.

The ingredients for Composition A were dry-blended, and the blend fed to a Werner Pfleiderer ZSK co-rotating twin screw extruder heated to about 260° C. and fitted with a pelletizing die. The extrudate was chopped into pellets.

The ingredients for Composition B were dry-blended and the blend fed to a Werner-Pfleiderer ZSK extruder heated to 315°-345° C. and fitted with a pelletizing die. The extrudate was chopped into pellets.

Two parts by weight of the pellets of Composition B and one part by weight of the pellets of composition A were dry-blended together and then dried in air for about 16 hours at about 150° C. The dried blend was melt-extruded at 315°-340° C. through a single screw extruder fitted with a cross-head die around two preheated 18 AWG stranded nickel-coated copper wires whose centers are about 0.29 inch apart, to produce an extrudate having a cross-section of dumbbell shape as shown in FIG. 1, the distance between the closest points of the electrodes being about 0.235 inch the thickness of the central section (t) being about 0.030 inch and the thickness of the end sections (d) being about 0.070 inch. After the extrudate had cooled, two jackets were extruded around it, the inner jacket being 0.02 inch thick and composed of polyvinylidene fluoride having a melting point of about 156° C. (Kynar 460 from Pennwalt) and the outer being 0.025 inch thick and composed of a fluorinated ethylene/propylene copolymer having a melting point of about 247° C. (Teflon FEP 100 from du Pont). The jacketed strip was annealed at 175° C. in air for 4 to 9 hours. The product had a cross-section as shown in FIG. 1.

TABLE

| | Comp. A | | Comp. B | | Final Mix | |
|---|---|---|---|---|---|---|
| | Wt % | Vol % | Wt % | Vol % | Wt % | Vol % |
| Polyvinylidene Fluoride having a melting point of about 160° C. (Kynar 451 from Pennwalt) | 88.0 | 89.2 | | | 29.3 | 32.0 |
| $CaCO_3$ (Omya Bsh from Omya Inc.) | 3.0 | 2.0 | | | 1.0 | 0.7 |
| Carbon Black (Vulcan XC-72 from Cabot, particle size 300 Angstroms, surface area 254 $m^2/g$) | 9.0 | 8.8 | | | 3.0 | 3.2 |
| Ethylene/tetrafluoroethylene copolymer having a melting point of about 270° C. (Tefzel 2010) | | | 64.6 | 75.5 | 43.1 | 48.4 |
| Carbon Black (Continex HAF from Continental Carbon, particle size 290 Angstroms, surface area 80 $m^2/g$) | | | 15.0 | 16.5 | 10.0 | 10.6 |
| ZnO (Kadox 515 from Gulf and Western) | | | 20.0 | 7.2 | 13.3 | 4.5 |
| Processing aid (a titanate coupling agent available under the trade name KR-134S from Kenrich Chemical) | | | 0.4 | 0.8 | 0.3 | 0.6 |

In another test which can be used to determine whether a strip heater has satisfactory flexibility, a length of the heater is held at one end in a fixed holder and at the other end in a rotatable holder which can be rotated through 180°. The distance between the holders is fixed, usually at a value of 1 to 4 inch, e.g. 1.25 or 3.375 inch, and the heater is under a known tension, usually of 0.2 to 1 lb. e.g. 0.46 lb. The rotatable holder is rotated clockwise and anti-clockwise through 180° at a fixed rate, e.g. 15 cycles/minute. At intervals the PTC element is inspected to see whether it has cracked.

I claim:

1. A self-limiting heater suitable for use at line voltages of about 120 volts or more which comprises (a) a PTC element composed of a PTC conductive polymer composition which exhibits PTC behavior, which has a resistivity at 25° C. of at least $10^2$ ohm.cm and which comprises (i) 50 to 85%, by weight of the composition, of a polymer component which comprises a mixture of a first crystalline fluorinated polymer having a first melting point, $T_1$, which is from 100° C. to 175° C. and a second crystalline fluorinated polymer having a second melting point, $T_2$, which is at least 200° C., the ratio by weight of said first polymer to said second polymer being from 1:3 to 3:1, and (ii) a particulate filler component which has been dispersed in said polymer component and which comprises carbon black in amount 8 to 40% by weight of the composition; and (b) two electrodes which are are in electrical contact with said PTC element and which can be connected to a source of electrical power to cause current to flow through the PTC element;

said heater having a resistance at 25° of $R_{25}$ ohms. and a resistance at 25° C. after being maintained at a temperature of 160° C. for 1000 hours, $R_{1000}$, which is less than $2 \times R_{25}$.

2. A heater according to claim 1 wherein the first polymer is polyvinylidene fluoride.

3. A heater according to claim 2 wherein the second polymer is an ethylene/tetrafluoroethylene copolymer.

4. A heater according to claim 3 wherein the PTC element is substantially free from cross-linking.

5. A heater according to claim 1 wherein the ratio by weight of the first polymer to the second polymer is 1:2 to 2:1.

6. A heater according to claim 5 wherein said ratio is 0.5 to 1.

7. A heater according to claim 6 wherein said ratio is 0.6 to 0.8.

8. A heater according to claim 1 wherein said PTC composition contains 65 to 75% by weight of said polymer component, 10 to 15% by weight of carbon black and 10 to 25% by weight of non-conductive particulate filler.

9. A heater according to claim 1 wherein $T_2$ is at least $(T_1+70)$°C.

10. A heater according to claim 9 wherein $T_2$ is at least $(T_1+90)$°C.

11. A heater according to claim 1 wherein the carbon black is the sole conductive filler in the PTC composition.

12. A heater according to claim 1 wherein the amount of carbon black is 10 to 15% by weight.

13. A heater according to claim 1 wherein the PTC composition contain 10 to 25% by weight of a non-conductive filler.

14. A heater according to claim 1 wherein the first and second polymers are incompatible with each other.

15. A heater according to claim 1 which is a flexible elongate heating strip in which the PTC strip is elongate and flexible and has a resistivity of $10^2$ to $10^5$ ohm.cm, and the electrodes are elongate, parallel, flexible metal wires which are embedded in the PTC element.

16. A heater according to claim 15 wherein the first and second polymers are incompatible with each other.

17. A heater according to claim 1 wherein the conductive polymer composition has a resistivity at 25° C. of $10^2$ to $10^5$ ohm.cm, the first polymer is polyvinylidene fluoride and the second polymer is an ethylene/tetrafluoroethylene copolymer.

* * * * *